US005924389A

United States Patent [19]

Palkes et al.

[11] Patent Number: 5,924,389

[45] Date of Patent: Jul. 20, 1999

[54] HEAT RECOVERY STEAM GENERATOR

[75] Inventors: Mark Palkes, Glastonbury, Conn.; Richard E. Waryasz, Longmeadow, Mass.

[73] Assignee: Combustion Engineering, Inc., Windsor, Conn.

[21] Appl. No.: 09/054,426

[22] Filed: Apr. 3, 1998

[51] Int. Cl.[6] ..... F22D 1/00

[52] U.S. Cl. ..... 122/7 R; 122/451 S; 122/1 C; 122/1 B

[58] Field of Search ..... 122/7 R, 1 C, 122/1 B, 451 S

[56] References Cited

U.S. PATENT DOCUMENTS

| | | | |
|---|---|---|---|
| 3,841,270 | 10/1974 | Sokolowski | 122/7 R |
| 4,325,781 | 4/1982 | Proske et al. | 159/13 A |
| 4,854,121 | 8/1989 | Arii et al. | 122/7 R |
| 4,903,504 | 2/1990 | Nelson | 62/347 |
| 4,971,139 | 11/1990 | Khattar | 165/86 |
| 4,986,088 | 1/1991 | Nelson | 62/347 |
| 4,989,405 | 2/1991 | Duffy et al. | 122/7 R |
| 5,159,897 | 11/1992 | Franke et al. | 122/451 S |
| 5,189,988 | 3/1993 | Budin et al. | 122/451 S |
| 5,293,842 | 3/1994 | Loesel | 122/7 R |
| 5,735,236 | 4/1998 | Kastner et al. | 122/451 S |

*Primary Examiner*—Teresa Walberg
*Assistant Examiner*—Jiping Lu
*Attorney, Agent, or Firm*—Alix, Yale & Ristas, LLP

[57] ABSTRACT

The water flow circuit for a heat recovery steam generator includes both a low pressure circuit and a high pressure circuit. Both circuits are designed for once-through flow and both include evaporators with rifled tubing. A pressure equalizing header may be located between the evaporator and superheater and orifices may be located at the inlet to the evaporator for flow stability.

1 Claim, 3 Drawing Sheets

HEAT RECOVERY STEAM GENERATOR

BACKGROUND OF THE INVENTION

The present invention relates to heat recovery steam generators and particularly to their water flow circuits. Heat recovery steam generators are used to recover heat contained in the exhaust gas stream of a gas turbine or similar source and convert water into steam. In order to optimize the overall plant efficiency, they include one or more steam generating circuits which operate at selected pressures.

There are essentially three types of boilers as distinguished by the type of water flow in the evaporator tubes. They are natural circulation, forced circulation and once-through flow. The first two designs are normally equipped with water/steam drums in which the separation of water from steam is carried out. In such designs, each evaporator is supplied with water from the corresponding drum via downcomers and inlet headers. The water fed into the circuits recovers heat from the gas turbine exhaust steam and is transformed into a water/steam mixture. The mixture is collected and discharged into the drums. In the natural circulation design, the circulation of water/steam mixture in the circuits is assured by the thermal siphon effect. The flow requirement in the evaporator circuits demands a minimum circulation rate which depends on the operating pressure and a local heat flux. A similar approach is taken in the design of a forced circulation boiler. The major difference is in the sizes of the tubing and piping and the use of circulating pumps which provides the driving force required to overcome the pressure drop in the system.

In both natural and forced circulation designs, the circulation rate and, therefore, the mass velocity inside the evaporative circuits is sufficiently high to ensure that evaporation occurs only in the nucleate boiling regime. This boiling occurs under approximately constant pressure (constant temperature) and is characterized by a high heat transfer coefficient on the inside of a tube and continuous wetting of the tube inside surface. Both of these factors result in the need for less evaporative surfaces and a desirable isothermal wall condition around the tube circumference. Additionally, since the tube inside surface is wetted, the deposition of water soluble salts which may occur during water evaporation, is minimized. While the cost of evaporators is reduced, the cost of the total circulation system is high since there is a need for such components as drums, downcomers, circulating pumps, miscellaneous valves and piping, and associated structural support steel.

The third type of boiler is a once-through steam generator. These designs don't include drums and their small size start up system is less expensive than the circulation components of either a forced circulation or a natural circulation design. There is no recirculation of water within the unit during normal operation. Demineralizers may be installed in the plant to remove water soluble salts from the feedwater. In elemental form, the once-through steam generator is merely a length of tubing through which water is pumped. As heat is absorbed, the water flowing through the tubes is converted into steam and is superheated to a desired temperature. The boiling is not a constant pressure process (saturation temperature is not constant) and the design results in a lower long-mean-temperature-difference or logarithmic temperature difference which represents the effective difference between the hot gases and the water and/or steam. In addition, since the complete dryout of fluid is unavoidable, in once-through designs the tube inside heat transfer coefficient deteriorates as the quality of steam approaches the critical value. The inside wall is no longer wetted and the magnitude of film boiling is only a small fraction of the nucleate boiling heat transfer coefficient. Therefore, the lower logarithmic temperature difference and the lower inside tube heat transfer coefficient result in the need for a larger quantity of evaporator surface.

In the design of once-through steam generators there are a number of factors that must be considered. The most important one is evaporator mass velocity. It should be sufficiently large to promote nucleate boiling inside the evaporator tubes and, therefore, minimize evaporator surface. Unfortunately, the velocity required to achieve high inside tube heat transfer coefficient results in a significant fluid pressure drop. The consequence of this pressure drop is increased power consumption of the feed water pump and increased saturation temperature along the boiling path. The increase in saturation temperature of the working fluid results in a reduced log-mean-temperature-difference (LMTD) between the gas side and the working fluid. The reduced LMTD more than offsets the high heat transfer coefficient of nucleate boiling causing increase in heat transfer surface. The ability to reduce mass velocity is limited by the low heat transfer coefficient of film boiling and potential for producing intermittent flow regimes which are characterized by stratified and wave flow patterns. Neither of these flow patterns is desirable from the point of view of increased pressure loss, reduced heat transfer and potential for high non-isothermality around the tube circumference.

SUMMARY OF THE INVENTION

The present invention relates to a heat recovery steam generator and relates specifically to an improved water flow circuit for overall plant efficiency. The invention involves a once-through heat recovery steam generator with rifled tube evaporators. More specifically, the invention involves both a low pressure circuit and a high pressure circuit both designed for once-through flow and both including evaporators with rifled tubing. Additionally, a pressure equalizing header may be located between the evaporator and superheater and orifices can be installed at the inlet to the evaporator for flow stability.

DESCRIPTION OF THE PREFERRED EMBODIMENTS

Figure 1:
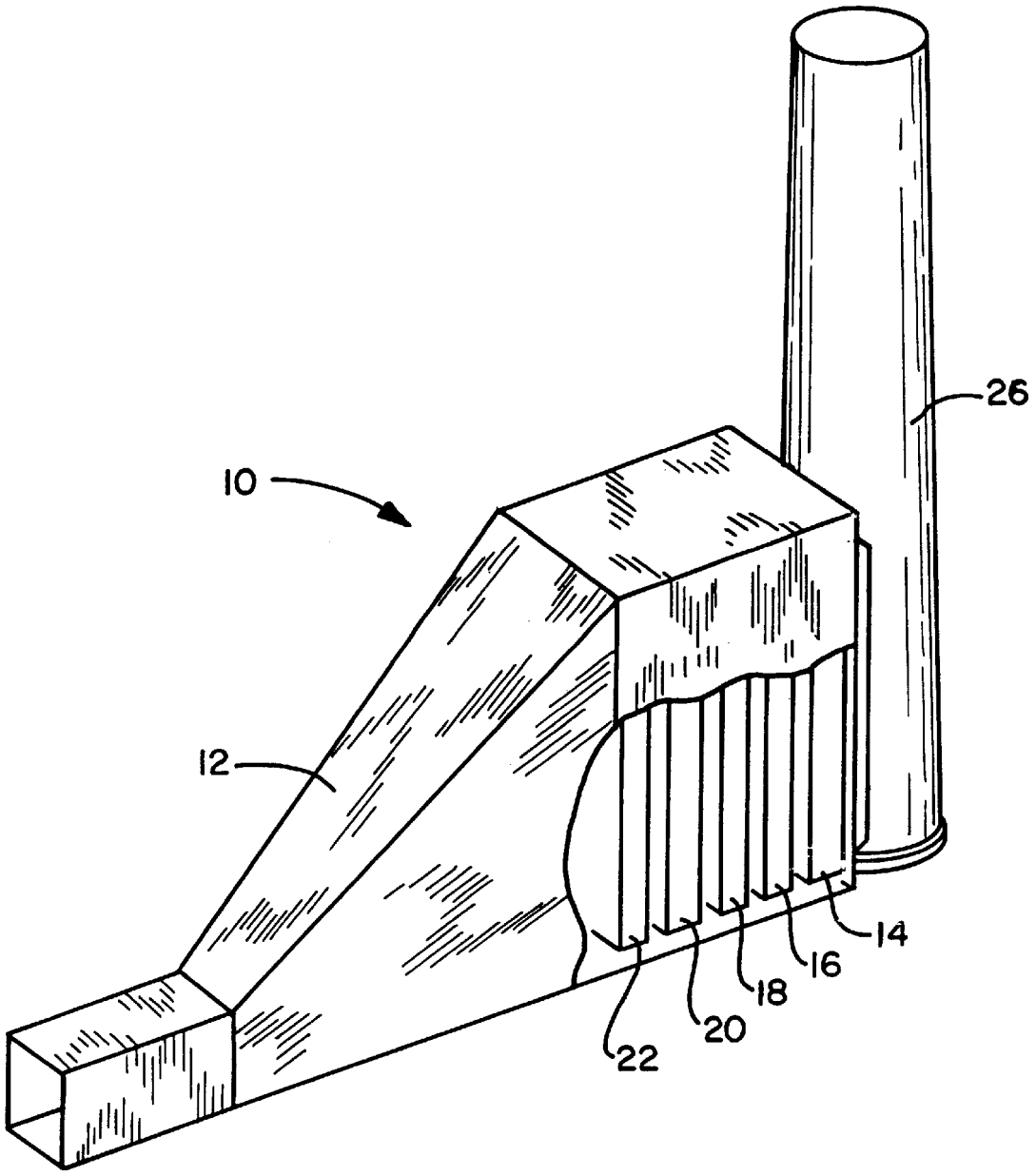
FIG. 1 is a general perspective view of a horizontal heat recovery steam generator.

FIG. 1 is a perspective view of a typical heat recovery steam generator generally designated 10. This particular unit is of the horizontal type but the present invention would be equally applicable to units with vertical gas flow. An example of the use of such heat recovery steam generators is for the exit gas from a gas turbine which has a temperature in the range of 425 to 540° C. (about 800 to 1,000° F.) and which contains considerable heat to be recovered. The generated steam can then be used to drive an electric generator with a steam turbine or may be used as process steam.

The heat recovery steam generator 10 comprises an expanding inlet transition duct 12 where the gas flow is expanded from the inlet duct to the full cross-section containing the heat transfer surface. The heat transfer surface comprises the various tube banks 14, 16, 18, 20 and 22 which may, for example, comprise the low pressure economizer, the low pressure evaporator, the high pressure economizer, the high pressure evaporator and the high pressure superheater respectively. Also shown in this FIG. 1 is the flue gas stack 26. The present invention involves the arrangement and the operating conditions of this heat exchange surface.

Figure 2:
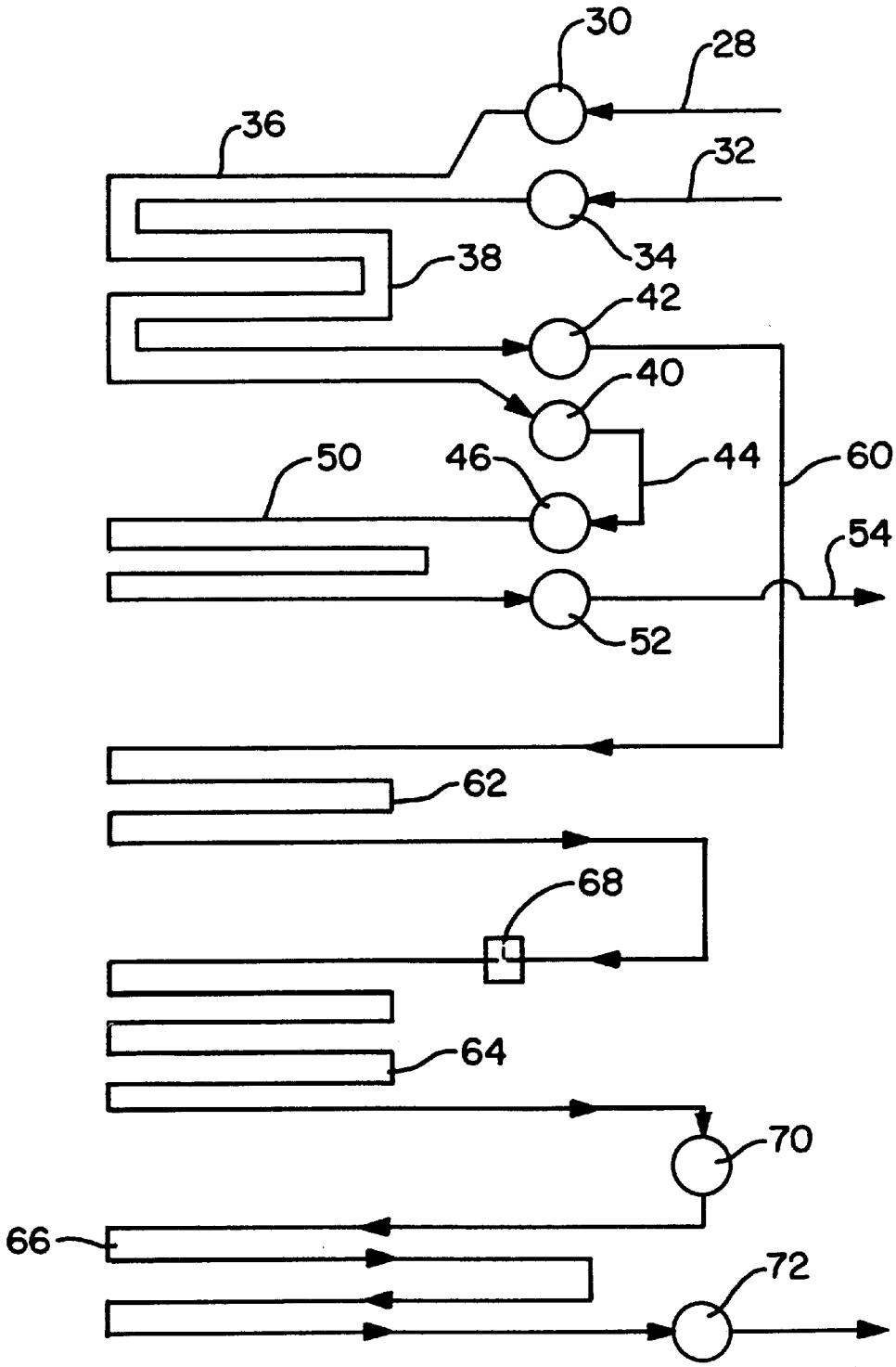
FIG. 2 is a schematic flow diagram illustrating a steam generator flow circuit of the present invention.

FIG. 2 schematically illustrates the arrangement of the heat exchange surface for one of the embodiments of the present invention. Beginning with the feedwater, the low pressure feedwater 28 is fed to the collection/distribution header 30 and the high pressure feedwater 32 is fed to the collection/distribution header 34. The low pressure feedwater is then fed from the header 30 into the low pressure economizer tube bank represented by the circuit 36 while the high pressure feedwater is fed from the header 34 into the high pressure economizer tube bank represented by the circuit 38. The partially heated low pressure flow from the low pressure economizer tube bank 36 is collected in the header 40 and the partially heated high pressure flow from the high pressure economizer tube bank 38 is collected in the header 42.

The partially heated low pressure flow from the header 40 is fed via line 44 to the collection/distribution header 46 and then through the low pressure evaporator 50 where the evaporation to steam occurs. The direction of flow in the low pressure evaporator 50 may either be horizontal or upward. The steam, most likely saturated steam, is collected in the header 52 and discharged at 54 as low pressure steam. As can be seen, this low pressure circuit is a once-through circuit. This low pressure evaporator of the present invention is formed from rifled tubing as will be explained hereinafter.

Turning now to the high pressure, once-through circuit, the partially heated high pressure stream 60 from the collection header 42 is fed in series through the second high pressure economizer tube bank 62, the high pressure evaporator 64 and into the high pressure superheater 66. The flow in the high pressure evaporator can be either upward, horizontal or downward. Orifices, generally designated 68 are installed in the inlet of each tube of the evaporator tube bank 64 for flow stability. An intermediate header 70 between the evaporator 64 and the high pressure superheater 66 improves stability and minimizes orifice pressure drop. This intermediate header 70 equalizes pressure loss between the tubes of the high pressure evaporator 64 and minimizes the effect of any flow or heat disturbances in the superheater 66 on the evaporator 64. The superheated steam is then collected in and discharged from the header 72. As can be seen, this high pressure circuit is a once-through circuit all the way from the high pressure feed 32 to the outlet header 72. As with the evaporator 50 in the low pressure circuit, the evaporator 64 in the high pressure circuit is also formed from rifled tubing.

In the present invention, the rifled tubing in the evaporators achieves cost reductions because conventional materials can now be used and because the mass flows can be reduced. The rifled tubing creates additional flow turbulence and delays the onset of the dryout of the wall tubes. The rifling produces nucleate boiling at lower mass flow than with a smooth bore tube. The benefit of rifled tubing extends beyond nucleate boiling. The increased turbulence in the film boiling regime induces heat transfer characteristics that are significantly better than the ones observed in smooth bore tubes. This means that the evaporators can now be smaller. The benefit from the rifled tubing applies to supercritical designs as well as subcritical designs and the direction of flow inside the evaporators can be either upward or downward. Orifices may be installed at the evaporator inlet for flow stability. An intermediate header between the evaporator and superheater is provided to improve stability and minimize orifice pressure drop. This header equalizes pressure loss between the evaporator tubes and minimizes the effect of any flow or heat disturbances in the superheater or the evaporator.

Figure 3:
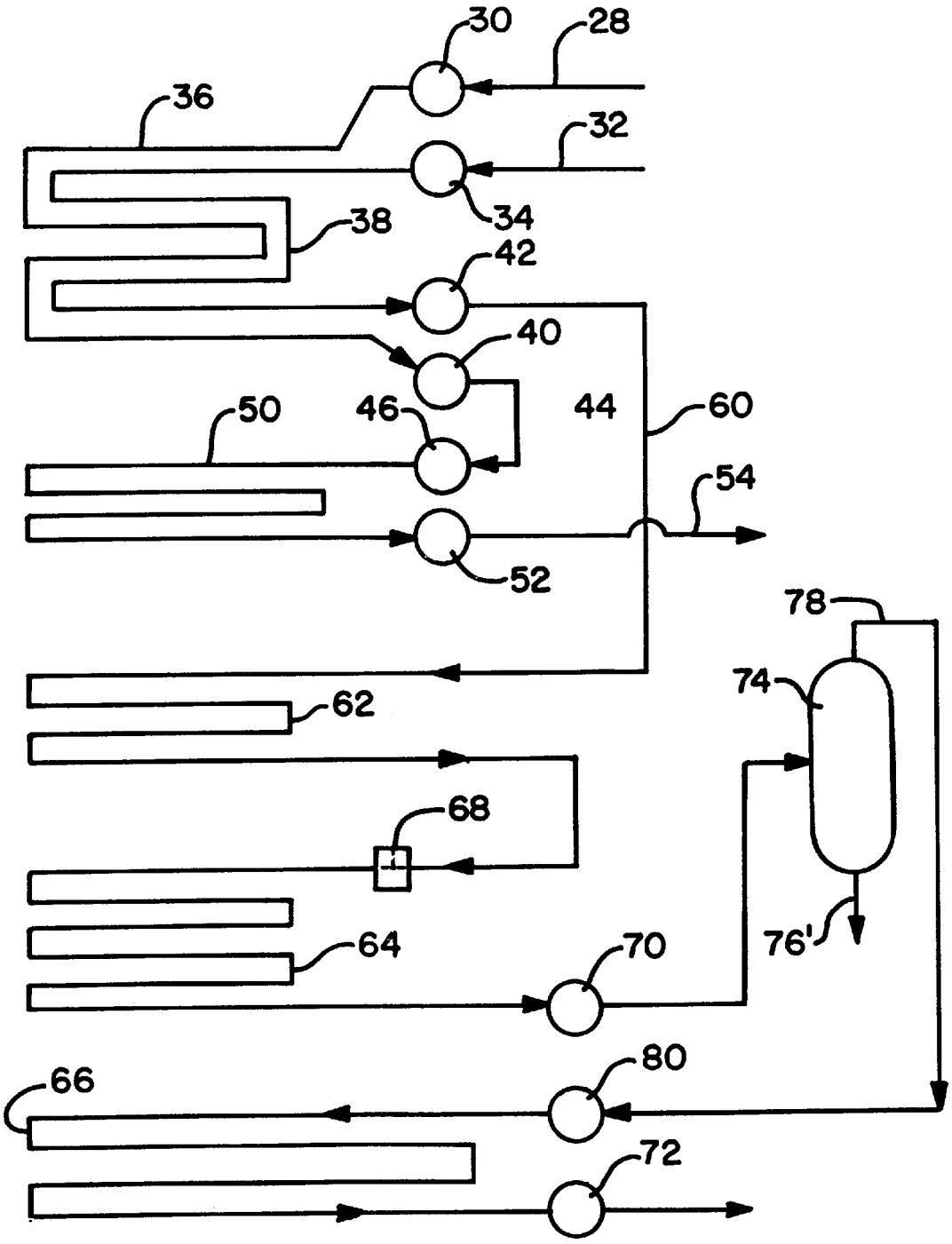
FIG. 3 is a schematic flow diagram similar to FIG. 1 but showing an alternate embodiment.

FIG. 3 is a variation of the present invention which includes a separator 74 for use during start-up. Under start-up conditions where the evaporator 64 produces saturated steam, the evaporator output from the pressure equalizing header 70 goes to the separator 74 where liquid water 76 is separated from saturated steam 78. This dry steam 78 then goes to the header 80 and through the superheater 66. During once-through operation, the separator serves as a mixing header.

As can be seen, the present invention is a heat recovery steam generator which embodies a once-through design featuring the following new components:

1. A rifled tube evaporator which makes operation practical at low fluid velocities. The high heat transfer coefficients which are produced reduce the heat transfer surface requirement. Additionally, isothermal conditions are maintained around the circumference of the tube wall throughout the load range. The isothermal condition minimizes stresses in the tube and in the attached external fins, and maintains a protective magnetite layer on the tube inside surface.
2. A pressure equalizing header located between the evaporator and the superheater heat transfer sections minimizes the effect of gas side unbalances on flow stability. This header reduces the requirement for inlet orifice pressure loss required by flow stability considerations.

We claim:

1. In a heat recovery steam generator wherein heat is recovered from a hot gas flowing in heat exchange contact with steam generating circuits, said steam generating circuits comprising the combination of:

a. a first once-through circuit operating at a first pressure and including a low pressure economizer section and a low pressure evaporator section for producing a low pressure steam output wherein said low pressure evaporator has a plurality of parallel tubes and wherein said parallel tubes of said low pressure evaporator section are rifled, and b. a second once-through flow circuit operating at a second pressure higher than said first pressure and including a high pressure economizer section with a plurality of parallel tubes, a high pressure evaporator section with a plurality of parallel tubes and a high pressure superheater section with a plurality of parallel tubes for producing a high pressure steam output and wherein said parallel tubes of said high pressure evaporator section are rifled and further including a pressure equalizing header between said high pressure evaporator section tubes and said high pressure superheater section tubes and a flow stabilizing orifice between the outlet of each tube of said high pressure economizer section and the inlet of each tube of said high pressure evaporator section.

* * * * *